United States Patent [19]

Spamer

[11] 4,454,948

[45] Jun. 19, 1984

[54] GRAVITY FEED DISPLAY UNIT

[75] Inventor: William S. Spamer, Roswell, Ga.

[73] Assignee: The Mead Corporation, Dayton, Ohio

[21] Appl. No.: 323,962

[22] Filed: Nov. 23, 1981

[51] Int. Cl.[3] ..... A47F 5/00

[52] U.S. Cl. ..... 211/49 D; 108/108

[58] Field of Search ..... 211/49 D, 134, 153; 108/108; 248/467, 205.3

[56] References Cited

U.S. PATENT DOCUMENTS

| | | | |
|---|---|---|---|
| 2,160,102 | 5/1939 | Hull | 211/49 D |
| 2,492,411 | 12/1949 | Barnes et al. | 248/467 |
| 2,623,641 | 12/1952 | Shield | 211/49 D |
| 2,954,128 | 9/1960 | Gordon | 211/49 D |
| 3,102,499 | 9/1963 | Shelor | 108/108 X |
| 3,845,864 | 11/1974 | Heinrich | 211/153 |
| 4,128,177 | 12/1978 | Bustos | 211/49 D |
| 4,314,648 | 2/1982 | Spamer | 211/49 D |
| 4,316,783 | 1/1979 | Karashima | 211/49 D |

FOREIGN PATENT DOCUMENTS

| | | | |
|---|---|---|---|
| 2385365 | 10/1978 | France | 211/49 D |

*Primary Examiner*—William E. Lyddane
*Assistant Examiner*—Peter A. Aschenbrenner
*Attorney, Agent, or Firm*—Rodgers & Rodgers

[57] ABSTRACT

A gravity feed display unit for mounting on a generally horizontal support surface includes a wedge shaped structure arranged for mounting on said support surface in such manner that an upper surface thereof is disposed in an inclined plane, a transverse rail having a pair of transverse vertically spaced flanges for receiving therebetween the lowermost edge of said wedge shaped structure and having a transverse bumper extending upwardly from said lowermost edge of said wedge shaped structure, and a plurality of generally channel shaped low friction elements mounted on said wedge shaped structure in side by side relation and forming a plurality of downwardly inclined guide paths for respectively receiving a plurality of rows of articles, the lowermost of which in each row is engageable with said transverse bumper whereby movement thereof is arrested.

2 Claims, 3 Drawing Figures

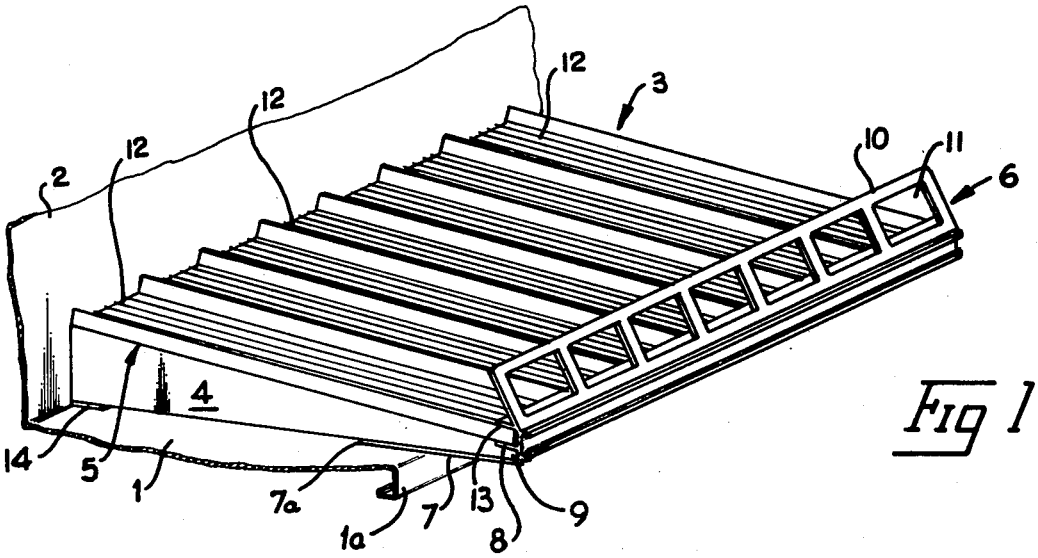
FIG 1
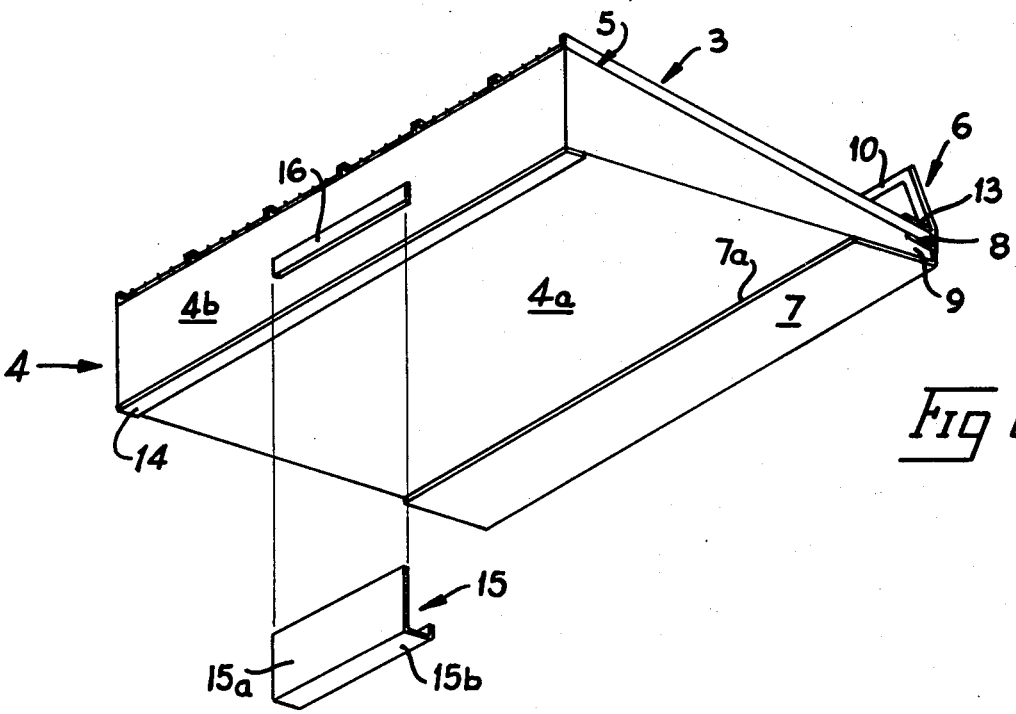
FIG 2
FIG 3
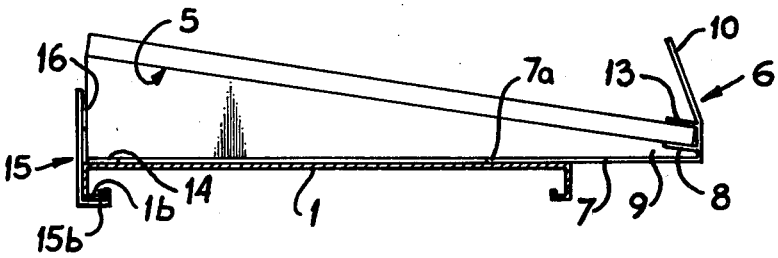

GRAVITY FEED DISPLAY UNIT

TECHNICAL FIELD

This invention relates generally to display devices of the gravity feed type which are used primarily in conjunction with point of purchase marketing of consumer items such as soft drinks and the like.

BACKGROUND ART

U.S. Pat. No. 4,136,783 issued Jan. 30, 1979 and titled "Showcase Equipment" discloses a display device in which shelves of a display unit include a wedge shaped structure mounted at the rear of each shelf together with a moveable display member mounted on the shelf and wedge shaped structure for conveying items forwardly on the shelf as forward items are moved by customers.

DISCLOSURE OF THE INVENTION

In accordance with this invention in one form, a wedge shaped structure is arranged for mounting on a generally horizontal support in such manner that an upper surface thereof is disposed in an inclined plane and a transverse rail is provided with a pair of vertically spaced transverse flanges for receiving therebetween the lowermost edge of the wedge shaped structure so as to afford a transverse bumper extending upwardly together with a plurality of generally channel shaped low friction elements mounted on the wedge shaped structure in side by side relation and forming a plurality of downwardly inclined guide paths for respectively receiving a plurality of rows of articles the lowermost of which in each row is engageable with said bumper whereby movement thereof is arrested. In accordance with a feature of the invention a third transverse flange is provided and is spaced above the upper one of said pair of transverse flanges so as to form a channel for receiving the lower end of said low friction elements and a suitable tape having adhesive on opposite surfaces thereof is arranged for adherance to a bottom of said wedge shaped structure and to the upper surface of a support so as to secure the wedge shaped structure in place. In accordance with another feature of the invention, tape having adhesive on opposite surfaces is secured to the back surface of the wedge shaped structure and is arranged to engage a wall or to engage an L-shaped bracket in such manner that a horizontal leg or the L-shaped bracket engages the lower surface of a support so as to secure the wedge shaped structure in position on the support.

BRIEF DESCRIPTION OF THE DRAWINGS

In the drawings

FIG. 1 is a perspective view of a gravity feed display unit formed according to the invention and which shows the unit mounted on a horizontal support;

FIG. 2 is a perspective view from a vantage point below the unit and which shows the lower portion thereof and FIG. 3 is a cross sectional view of the unit illustrated in FIG. 2 and which shows that unit mounted on a support structure.

BEST MODE OF CARRYING OUT THE INVENTION

In the drawings the numeral 1 designates a horizontal support and the numeral 2 designates a vertical element which forms a part of horizontal support 1. Structures 1 and 2 could constitute a conventional horizontal shelf forming a component of a display unit for use in supermarket outlets and the like. The gravity feed display unit formed according to this invention is generally designated by the numeral 3 and as is apparent from FIG. 1, gravity display unit 3 is mounted atop horizontal support 1 and with its rear edge adjacent the vertical panel 2.

Gravity feed display unit 3 comprises a wedge shaped structure 4 which preferably is formed of foam material as is apparent particularly from FIGS. 1 and 3. The upper surface 5 of wedge shaped structure 4 is inclined downwardly and away from vertical panel or wall 2 and thus surface 5 lies in an inclined plane.

A transverse rail structure generally designated by the numeral 6 includes a pair of transverse vertically spaced flanges 7 and 8 which receive therebetween the front or lowermost edge 9 of the wedge shaped structure 4. Rail structure 6 also includes a transverse bumper bar 10 which extends above the lowermost or front edge of wedge shaped structure 4. Windows as indicated at 11 are formed in bumper structure 10 for affording product visibility.

For receiving a plurality of rows of articles to be displayed, a plurality of channel shaped low friction elements designated by the numeral 12 are mounted on the wedge shaped structure 4 in side by side relation so as to form a plurality of downwardly inclined guide paths for respectively receiving a plurality of rows of articles. The term "low friction" indicates that the friction on the upper surface of these channels is sufficiently low to allow the articles to slide downwardly in the channels due to gravity at the angle of inclination of the inclined plane which is the upper surface of the wedge shaped structure 4. As is obvious, the lowermost article in each row of articles is arranged to engage the transverse bumper bar 10 which obviously arrests forward movement thereof.

For securing the lowermost end of the channels 12 in position relative to wedge shaped structure 4, a horizontal flange 13 is formed integrally with rail 6 and is spaced upwardly above the channel 8 so as to receive the lowermost ends of the channels 12 as is apparent in the drawings.

Since the gravity feed display unit generally designated by the numeral 3 and formed according to this invention may be used in conjunction with support structures designated by the numeral 1 and which may be of different dimensions from front to rear, it is possible that the front edge of display unit 3 may project outwardly beyond the front edge such as 1*a* of support 1. In this event it is desirable to provide supplementary support means for the front edge of wedge shaped structure 4. Toward this end the flange 7 is arranged as is obvious in the drawings to project rearwardly to the point indicated at 7*a* and by this means to provide support for the front edge of wedge shaped structure 4 as is shown in the drawings.

In order to secure the gravity feed display unit 3 in position atop a support such as that indicated by the numeral 1, a tape designated by the numeral 14 is provided in accordance with one facet of this invention. Tape 14 is the type which includes adhesive on its opposite surfaces. Thus with the tape 14 secured to the bottom surface 4*a* of the wedge shaped structure 4 and near the rear part thereof, adhesive on the lowermost surface of tape 14 forms a bond with support 1. This adhesive action secures the wedge shaped structure 4 in position on support 1.

In instances where the vertical panel 2 is not employed or where support 1 is spaced horizontally from a vertical panel such as 2, it is desirable to provide supplementary securing means in the form of the L-shaped bracket designated by the numeral 15 and as shown in FIGS. 2 and 3. L-shaped bracket 15 is secured to the rear panel **4*b* of wedge shaped structure by means of tape 16 which like tape 14 is provided with adhesive on opposite surfaces thereof. Thus with the tape 16 securely adhered to the rear surface 4*b* of wedge shaped structure 4, the bracket 15 having upright component 15*a* is arranged with panel 15*a* secured to the outer surface of tape 16 simply by removal of the strip of masking material which overlies the outer surface of tape 16. Thereafter panel 15*a* of bracket 15 may be secured to tape 16 at the desired elevation so that the horizontal panel 15*b* of bracket 15 underlies a lower surface such as 1*b* which forms a part of structure 1. Thus by this means bracket 15 aids in securing the gravity feed unit 3 in position atop support 1. In appropriate situations, it may be desirable to use either the tape 14 or the tape 16 or in some instances both these units and the brackets 15 may be employed. For some applications of the invention, it is desirable to secure the panel 15*a* of bracket 15 to the rear 4*b*** of wedge shaped structure by suitable mechanical means such as screws, nails, or a complementary bracket or the like as is obvious.

INDUSTRIAL APPLICABILITY

This invention is particularly well suited to provide an economical gravity feed unit for use in installations where generally horizontally disposed support surfaces are already in existence. Such support surfaces may constitute a building floor or a horizontal shelf of a conventional shelf unit or some other support surface such as a counter top.

I claim:

1. A gravity feed display unit for displaying articles and comprising a wedge shaped structure having a thin lowermost edge and flat upper and lower surfaces and being arranged for mounting on a generally horizontal support in such manner that the flat upper surface thereof is disposed in an inclined plane and the flat bottom surface thereof including its rear edge is generally horizontal, a generally horizontal rail transverse to said inclined plane and having a pair of generally horizontal transverse vertically spaced flanges for receiving therebetween the lowermost edge of said wedge shaped structure and having a generally horizontal transverse bumper bar extending upwardly and transversely of said lowermost edge of said wedge shaped structure, a plurality of generally channel shaped low friction elements mounted on said wedge shaped structure in side by side relation and forming a plurality of downwardly inclined guide paths for respectively receiving a plurality of rows of articles and having their lowermost ends abutting said rail, the lowermost article in each row being engageable with said transverse bumper bar whereby movement thereof is arrested, and said wedge shaped structure having a generally vertical rear surface, a tape having adhesive on opposite surfaces thereof secured to the rear surface of said wedge shaped structure so as to form a bond with a vertical panel at the rear of said wedge shaped structure, and a bracket of generally L-shaped configuration and whose vertical part is engageable with said tape in such manner that a horizontal part of said bracket underlies and engages a lower surface of said support so as to secure the rear of said wedge shaped structure against upward movement.

2. A gravity feed display unit for displaying articles and comprising a wedge shaped structure having a thin lowermost edge and flat upper and lower surfaces and being arranged for mounting on a generally horizontal support in such manner that the flat upper surface thereof is disposed in an inclined plane and the flat bottom surface thereof including its rear edge is generally horizontal, a generally horizontal rail transverse to said inclined plane and having a pair of generally horizontal transverse vertically spaced flanges for receiving therebetween the lowermost edge of said wedge shaped structure and having a generally horizontal transverse bumper bar extending upwardly and transversely of said lowermost edge of said wedge shaped structure, a plurality of generally channel shaped low friction elements mounted on said wedge shaped structure in side by side relation and forming a plurality of downwardly inclined guide paths for respectively receiving a plurality of rows of articles and having their lowermost ends abutting said rail, the lowermost article in each row being engageable with said transverse bumper bar whereby movement thereof is arrested, and a bracket of generally L-shaped configuration arranged with its horizontal part disposed underneath and in engagement with a lower surface of said support and with its vertical part secured to the rear surface of said wedge shaped structure by mechanical means and at a level to secure the rear of said wedge shaped structure against upward movement.

* * * * *